US010601163B2

(12) United States Patent
Ju et al.

(10) Patent No.: US 10,601,163 B2
(45) Date of Patent: Mar. 24, 2020

(54) ELECTRICAL CONNECTOR

(71) Applicant: LOTES CO., LTD, Keelung (TW)

(72) Inventors: Ted Ju, Keelung (TW); Zhi Yong Zhou, Keelung (TW); Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/210,162

(22) Filed: Dec. 5, 2018

(65) Prior Publication Data

US 2019/0181579 A1 Jun. 13, 2019

(30) Foreign Application Priority Data

Dec. 8, 2017 (CN) ..... 2017 1 1292126
Mar. 14, 2018 (CN) ..... 2018 1 0208023

(51) Int. Cl.
*H01R 12/00* (2006.01)
*H01R 13/24* (2006.01)
(Continued)

(52) U.S. Cl.
CPC ..... *H01R 13/2464* (2013.01); *H01R 12/52* (2013.01); *H01R 12/55* (2013.01);
(Continued)

(58) Field of Classification Search
CPC H01R 13/2464; H01R 12/714; H01R 13/514; H01R 13/502; H01R 13/40;
(Continued)

(56) References Cited

U.S. PATENT DOCUMENTS 7,128,622 B2 * 10/2006 Tsai ..... H05K 3/3426 439/874
7,134,920 B1 * 11/2006 Ju ..... H05K 7/1069 439/691
(Continued)

FOREIGN PATENT DOCUMENTS

CN 2845216 Y 12/2006
CN 201478523 U 5/2010
(Continued)

*Primary Examiner* — Abdullah A Riyami
*Assistant Examiner* — Nelson R. Burgos-Guntin
(74) *Attorney, Agent, or Firm* — Locke Lord LLP; Tim Tingkang Xia, Esq.

(57) ABSTRACT

An electrical connector for electrically connecting a chip module to a circuit board includes a body for upwardly bearing the chip module. The body is provided with multiple accommodating holes. Each accommodating hole has a first groove and a second groove, and a width of the second groove is less than a width of the first groove. Multiple terminals are correspondingly accommodated in the accommodating holes. Each terminal includes: a base, accommodated in the first groove; an extending portion, bending and extending from one side of the base and accommodated in the second groove; a conducting portion, provided on a bottom portion of the terminal to be electrically connected with the circuit board; and an elastic portion, formed by upwardly bending and extending from the extending portion to abut the chip module.

20 Claims, 12 Drawing Sheets

(51) Int. Cl.

| | |
|---|---|
| ***H01R 12/55*** | (2011.01) |
| ***H01R 12/52*** | (2011.01) |
| ***H01R 12/70*** | (2011.01) |
| ***H01R 13/40*** | (2006.01) |
| ***H01R 13/502*** | (2006.01) |
| ***H01R 13/514*** | (2006.01) |
| ***H01R 12/71*** | (2011.01) |
| ***H01R 12/57*** | (2011.01) |
| ***H01R 13/41*** | (2006.01) |

(52) U.S. Cl.
CPC ..... *H01R 12/57* (2013.01); *H01R 12/7076* (2013.01); *H01R 12/714* (2013.01); *H01R 13/40* (2013.01); *H01R 13/41* (2013.01); *H01R 13/502* (2013.01); *H01R 13/514* (2013.01)

(58) Field of Classification Search
CPC .... H01R 12/7076; H01R 12/52; H01R 12/55; H01R 13/41; H01R 12/57; H01R 13/24; H01R 13/02
USPC ..... 439/66, 591
See application file for complete search history.

(56) References Cited

U.S. PATENT DOCUMENTS 7,791,443 B1 * 9/2010 Ju ..... H01R 12/52 336/107
8,215,998 B1 * 7/2012 Ju ..... H01R 12/7076 439/626
8,235,734 B2 * 8/2012 Ju ..... H01R 12/57 439/83
8,246,360 B1 * 8/2012 Tsai ..... H01R 12/55 439/66
8,323,038 B2 * 12/2012 Jin ..... H01R 12/714 439/66
8,360,790 B2 * 1/2013 Ju ..... H01R 12/716 439/66
8,708,716 B1 * 4/2014 Ho ..... H01R 12/714 439/83
8,851,904 B2 * 10/2014 Chang ..... H01R 12/71 439/607.03
8,894,422 B2 * 11/2014 Yeh ..... H01R 12/57 439/83
9,954,312 B1 * 4/2018 Ju ..... H01R 12/707
10,062,982 B2 * 8/2018 Ju ..... H01R 12/57
10,230,177 B2 * 3/2019 Ju ..... H01R 13/2442
2003/0114029 A1 * 6/2003 Lee ..... H01R 4/028 439/83
2003/0203660 A1 * 10/2003 Kassa ..... H05K 3/3426 439/65
2014/0242839 A1 * 8/2014 Cai ..... H01R 13/6471 439/607.01
2015/0171540 A1 * 6/2015 Huang ..... H01R 12/52 439/722
2018/0205161 A1 * 7/2018 Ju ..... H01R 12/57
2019/0181579 A1 * 6/2019 Ju ..... H01R 12/57
2019/0214761 A1 * 7/2019 Ho ..... H01R 12/52
2019/0221956 A1 * 7/2019 Ho ..... H01R 12/52

FOREIGN PATENT DOCUMENTS

CN 201797121 U 4/2011
CN 202076467 U 12/2011

* cited by examiner

100

100

A–A

100

B-B

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201711292126.0 filed in China on Dec. 8, 2017 and patent application Serial No. CN201810208023.X filed in China on Mar. 14, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector for electrically connecting a chip module.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In the related art, an electrical connector is used for electrically connecting a chip module with a circuit board, and includes an insulating body and a plurality of conductive terminals accommodated in the insulating body.

Each conductive terminal is formed by stamping a metal material integrally, and includes a flat retaining portion, a bending portion bending and extending from one side of the retaining portion, an elastic portion upwardly bending and extending from a top end of the bending portion, and a soldering portion downwardly bending and extending from a bottom end of the retaining portion. The two opposite sides of the retaining portion are provided with a plurality of barbs. The tail end of the elastic portion is provided with a curved-shaped contact portion, which can be conductively connected with the chip module. The soldering portion extends from a middle portion of the bottom end of the retaining portion, and has a horizontal curved plate-shaped structure. The bottom of the soldering portion can be soldered to a solder ball, and the conductive terminal can be soldered to the circuit board through the solder ball.

The insulating body is made of an insulating material, and is provided with a plurality of terminal grooves for accommodating the conductive terminals. Each terminal groove includes an accommodating groove with an approximately rectangular cross-section and a retaining slot communicating with the accommodating groove and located at one side of the accommodating groove. Each conductive terminal are fixed on the corresponding wall surfaces of the retaining groove by the interference of the barbs on the retaining portion, such that the conductive terminal is retained in the insulating body, while the bending portion of each conductive terminal is accommodated in the accommodating groove and the bending portion have a large moving space in the accommodating groove.

However, the electrical connector only depends on the interference fixing between the barbs on the retaining portion and the corresponding wall surfaces of the retaining groove to retain each conductive terminal in the insulating body. When the chip module presses downward on the elastic portion, a distance between the contact portion and the retaining portion is large, and the accommodating groove lack a position limiting effect on the bending portion, thereby resulting in the bending portion to be easily shaken in the accommodating groove, and further affecting the stable conduction between the conductive terminals and the chip module.

Therefore, a heretofore unaddressed need to design a novel electrical connector exists in the art to address the aforementioned deficiencies and inadequacies.

SUMMARY

The present invention is directed to an electrical connector which can stably retain terminals in a body to prevent the terminals from shaking in the body, thus ensuring the stable conduction between the terminals and a chip module.

In order to achieve the foregoing objective, the present invention adopts the following technical solution:

An electrical connector configured to electrically connect a chip module to a circuit board includes: a body configured to upwardly bear the chip module, wherein the body is provided with a plurality of accommodating holes, each of the accommodating holes has a first groove and a second groove, and a width of the second groove is less than a width of the first groove; and a plurality of terminals, correspondingly accommodated in the accommodating holes, wherein each of the terminals includes: a base, accommodated in the first groove; an extending portion, bending and extending from one side of the base and accommodated in the second groove; a conducting portion, provided on a bottom portion of the terminal and configured to be electrically connected with the circuit board; and an elastic portion, formed by upwardly bending and extending from the extending portion and configured to abut the chip module.

In certain embodiments, each of the accommodating holes includes a first wall surface and a second wall surface provided opposite to each other, the first wall surface and the second wall surface jointly define the first groove, and the second groove runs through the first wall surface and communicates with the first groove.

In certain embodiments, the first wall surface and the second wall surface are provided obliquely relative to each other.

In certain embodiments, an inner wall of each of the accommodating holes is provided with two protruding blocks opposite to each other, and the two protruding blocks jointly define the second groove.

In certain embodiments, a top portion of each of the protruding blocks is obliquely provided with a guide surface.

In certain embodiments, each of the accommodating holes is provided with a third wall surface and a fourth wall surface, a protruding block is formed by extending from the third wall surface toward the accommodating hole, and the protruding block and the fourth wall surface jointly define the second groove.

In certain embodiments, each of the accommodating holes further includes a fifth wall surface connected with the third wall surface and the fourth wall surface, and the protruding block is connected with the fifth wall surface.

In certain embodiments, the body is concavely provided with a plurality of recess grooves corresponding to the accommodating holes, wherein each of the recess grooves is downward concavely provided from one side of the second groove of a corresponding accommodating hole of the accommodating holes, each of the recess grooves communicates with the second groove of the corresponding accommodating hole, a width of each of the recess grooves is greater than the width of the second groove of the corresponding accommodating hole, and each of the recess grooves and the first groove of the corresponding accommodating hole are located on two opposite sides of the second groove of the corresponding accommodating hole.

In certain embodiments, the extending portion of each of the terminals is partially accommodated in a corresponding one of the recess grooves.

In certain embodiments, two opposite sides of the base are provided with a plurality of fastening portions, the fastening portions are configured to be in interference fit with the first groove, a bottom end of at least one of the fastening portions has a position limiting portion, and the first groove has a position limiting surface located below the position limiting portion and configured to limit each of the terminals from moving downward.

In certain embodiments, the extending portion has a stopping portion, and the second groove has a stopping surface located below the stopping portion and configured to limit each of the terminals from moving downward.

In certain embodiments, the base has a position limiting portion located below the stopping portion, and the first groove has a position limiting surface located below the position limiting portion and configured to limit each of the terminals from moving downward.

In certain embodiments, the extending portion is pierced and broken to form a protruding thorn, and the protruding thorn is in interference fit with the second groove.

In certain embodiments, a top end of the base extends upward to form a strip connecting portion configured to be connected with a strip, the body is provided with a plurality of protruding bars corresponding to the accommodating holes, each of the protruding bars protrudes upwardly from one side of the first groove of a corresponding accommodating hole of the accommodating holes, one side of each of the protruding bars located close to the strip connecting portion has an oblique surface, and a top end of the strip connecting portion is higher than a lower end of the oblique surface and lower than an upper end of the oblique surface.

In certain embodiments, the body is provided with a plurality of supporting blocks corresponding to the accommodating holes, each of the supporting blocks protrudes upwardly from the other side of the first groove of a corresponding accommodating hole of the accommodating holes, a top surface of each of the supporting blocks is higher than a top surface of each of the protruding bars, and the supporting blocks are configured to upwardly bear the chip module.

In certain embodiments, the conducting portion is formed by downwardly extending from a bottom end of the base, and the conducting portion and the circuit board are soldered by a solder.

In certain embodiments, a vertical central line of the conducting portion deviates from a vertical central line of the base in a horizontal direction.

In certain embodiments, the vertical central line of the conducting portion deviates from the vertical central line of the base toward a connecting location between the base and the extending portion.

In certain embodiments, the conducting portion is formed by vertically downwardly extending from a bottom end of the base, the body is provided with a retaining block protruding downward on one side of each of the accommodating holes, and the conducting portion and the retaining block clamp two opposite sides of a solder.

In certain embodiments, the conducting portion includes a first portion formed by downwardly extending from a bottom end of the base, a second portion formed by horizontally extending from the first portion, and a protruding portion formed by horizontally extending from the second portion, the protruding portion extends to be located right below the extending portion, and a bottom surface of the protruding portion is soldered to a solder.

Compared with the related art, the electrical connector according to certain embodiments of the present invention have the following beneficial effects:

The base is accommodated in the first groove, the extending portion is accommodated in the second groove, and the width of the second groove is less than the width of the first groove, thus ensuring a position limiting effect of the second groove to the extending portion, and further reducing a distance between the position where the terminal abuts the chip module and the position where the terminal is limited in the accommodating hole. When the chip module presses downward on the elastic portion, the shake of the extending portion in the second groove can be effectively reduced, thus ensuring the stable conduction between the terminals and the chip module.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
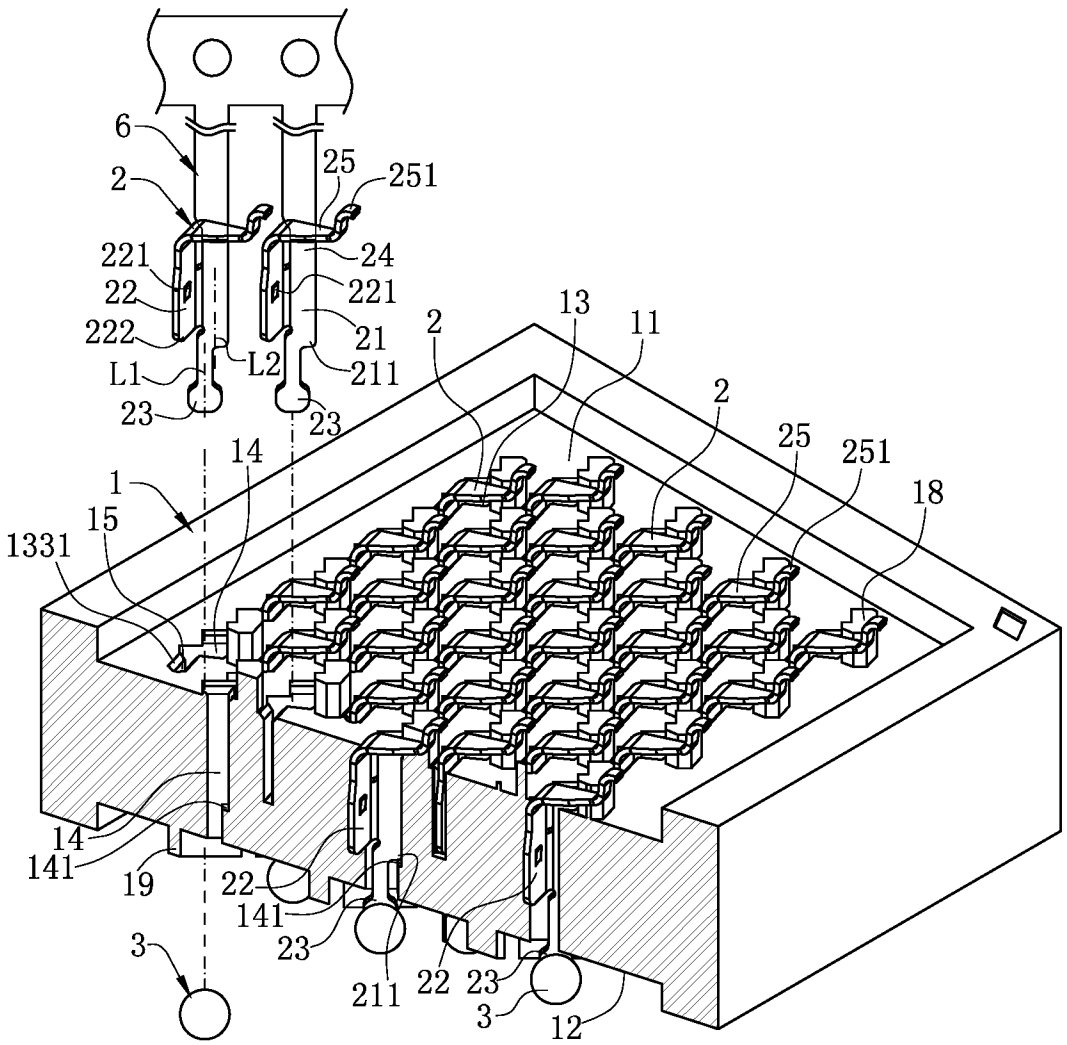
FIG. 1 is a perspective view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-12. In accordance with the purposes of this invention, as embodied and broadly described herein, this invention, in one aspect, relates to an electrical connector.

FIG. 1 to FIG. 7 show an electrical connector 100 according to a first embodiment of the present invention, which is configured to electrically connect a chip module 4 to a circuit board 5. The electrical connector 100 includes a body 1 for upwardly bearing the chip module 4, and a plurality of terminals 2 accommodated in the body 1.

Figure 3:
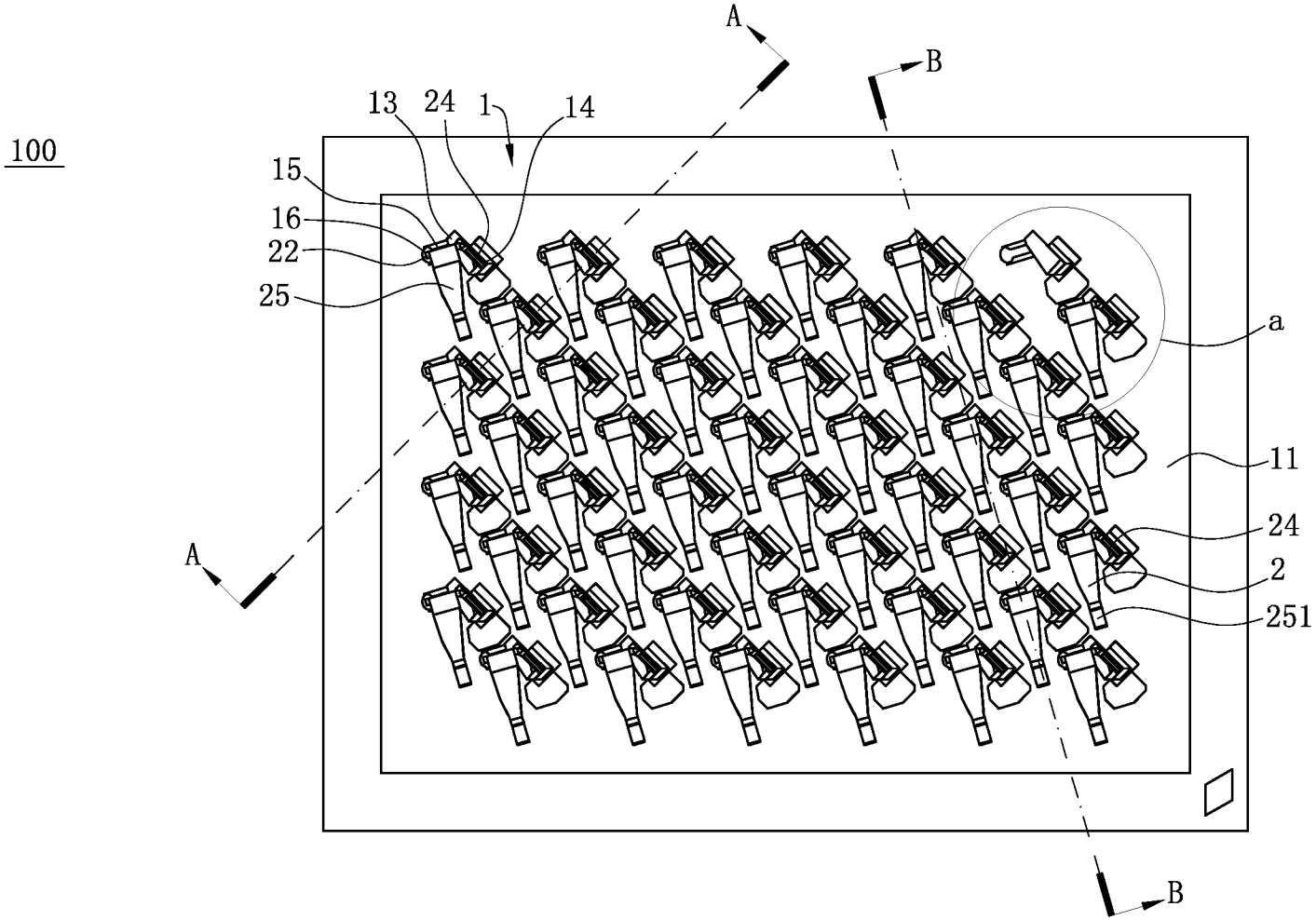
FIG. 3 is a top view of the electrical connector in FIG. 1.

As shown in FIG. 1 and FIG. 3, the body 1 is made of an insulating material. The body 1 has an upper surface 11 and a lower surface 12 opposite to each other, and the body 1 is provided with a plurality of accommodating holes 13 running through the upper surface 11 and the lower surface 12. The accommodating holes 13 are arranged in multiple rows, and each two adjacent rows of accommodating holes 13 are provided in a staggered way.

Figure 4:
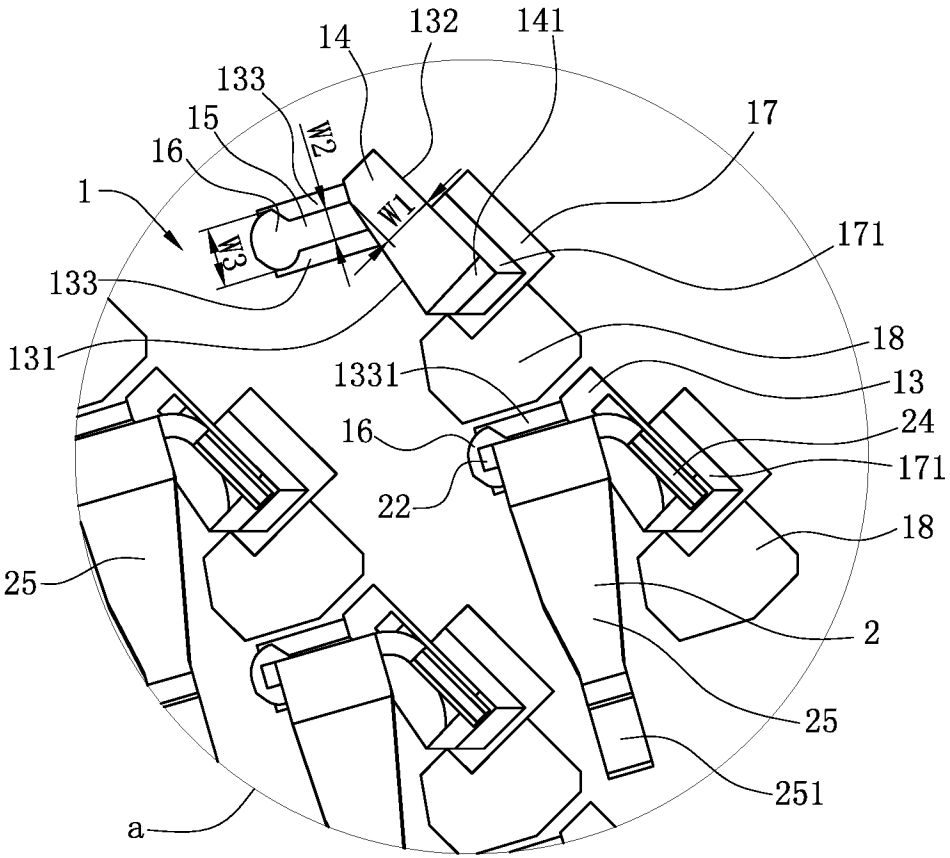
FIG. 4 is an enlarged view of portion a in FIG. 3.

As shown in FIG. 1 and FIG. 4, each accommodating hole 13 has a first groove 14 and a second groove 15, and a width W2 of the second groove 15 is less than a width W1 of the first groove 14.

Each accommodating hole 13 includes a first wall surface 131 and a second wall surface 132 provided opposite to each other. The first wall surface 131 and the second wall surface 132 are obliquely provided relative to each other, and jointly define the first groove 14. A distance between the first wall surface 131 and the second wall surface 132 is defined as the width W1 of the first groove 14.

A part of the first groove 14 does not run through the lower surface 12, thereby forming a position limiting surface 141. The position limiting surface 141 is connected with the first wall surface 131 and the second wall surface 132.

The inner wall of each accommodating hole 13 is provided with two opposite protruding blocks 133. The two protruding blocks 133 extend toward each other and jointly define the second groove 15. The second groove 15 runs through the first wall surface 131, and communicates with the first groove 14. The inner surfaces of the two protruding blocks 133 are parallel to each other. A distance between the inner surfaces of the two protruding blocks 133 is defined as the width W2 of the second groove 15. The top portion of each protruding block 133 is obliquely provided with a guide surface 1331.

The second groove 15 does not run through the lower surface 12 thereby forming a stopping surface 151. The stopping surface 151 is located above the position limiting surface 141 (see FIG. 6). The stopping surface 151 extends to the connecting location between the first groove 14 and the second groove 15.

The body 1 has a plurality of recess grooves 16 downwardly and concavely provided from the upper surface 11. Each recess groove 16 correspondingly communicates with a corresponding second groove 15. A width W3 of the recess groove 16 is greater than the width W2 of the second groove 15. The recess groove 16 and the first groove 14 are located on two opposite sides of the second groove 15. When the second groove 15 is formed by a pin, the strength of the pin can be enhanced.

Figure 5:
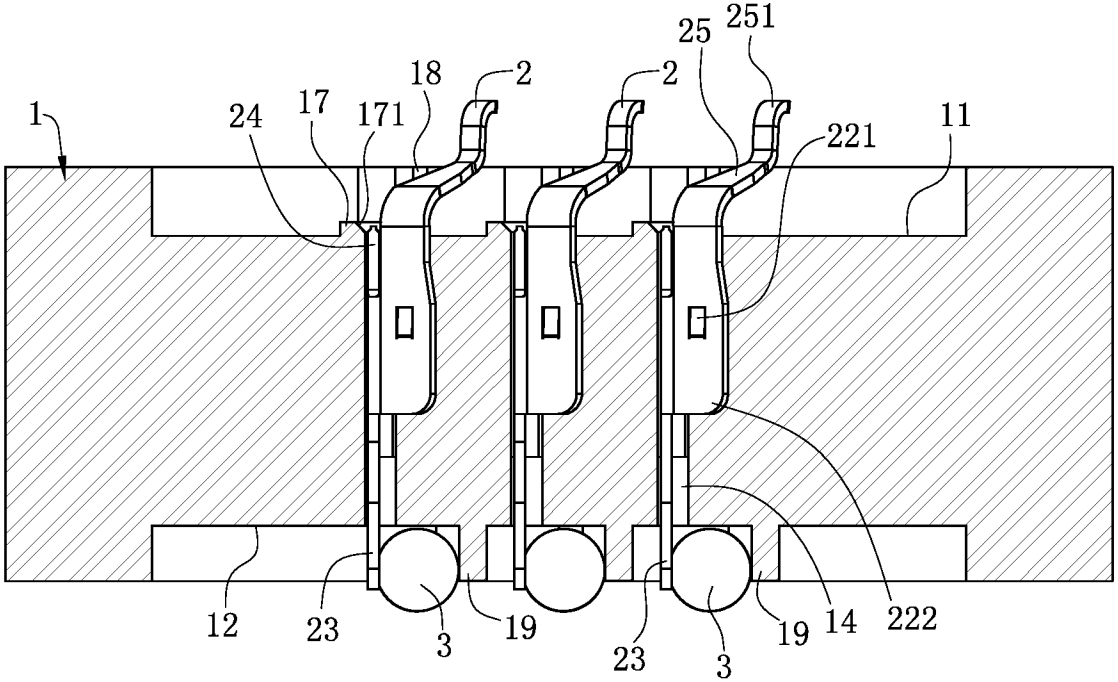
FIG. 5 is a sectional view of the electrical connector in FIG. 3 along an A-A direction.

As shown in FIG. 4 and FIG. 5, the body 1 has a plurality of protruding bars 17 formed by extending upward from the upper surface 11. One side of each first groove 14 is correspondingly provided with a protruding bar 17, and one side of each protruding bar 17 close to the first groove 14 is provided with an oblique surface 171.

The body 1 has a plurality of supporting blocks 18 formed by extending upward from the upper surface 11. The other side of each first groove 14 is correspondingly provided with a supporting block 18. A top surface of each supporting blocks 18 is higher than a top surface of each protruding bar 17. The supporting blocks 18 are configured to upwardly bear the chip module 4.

Figure 2:
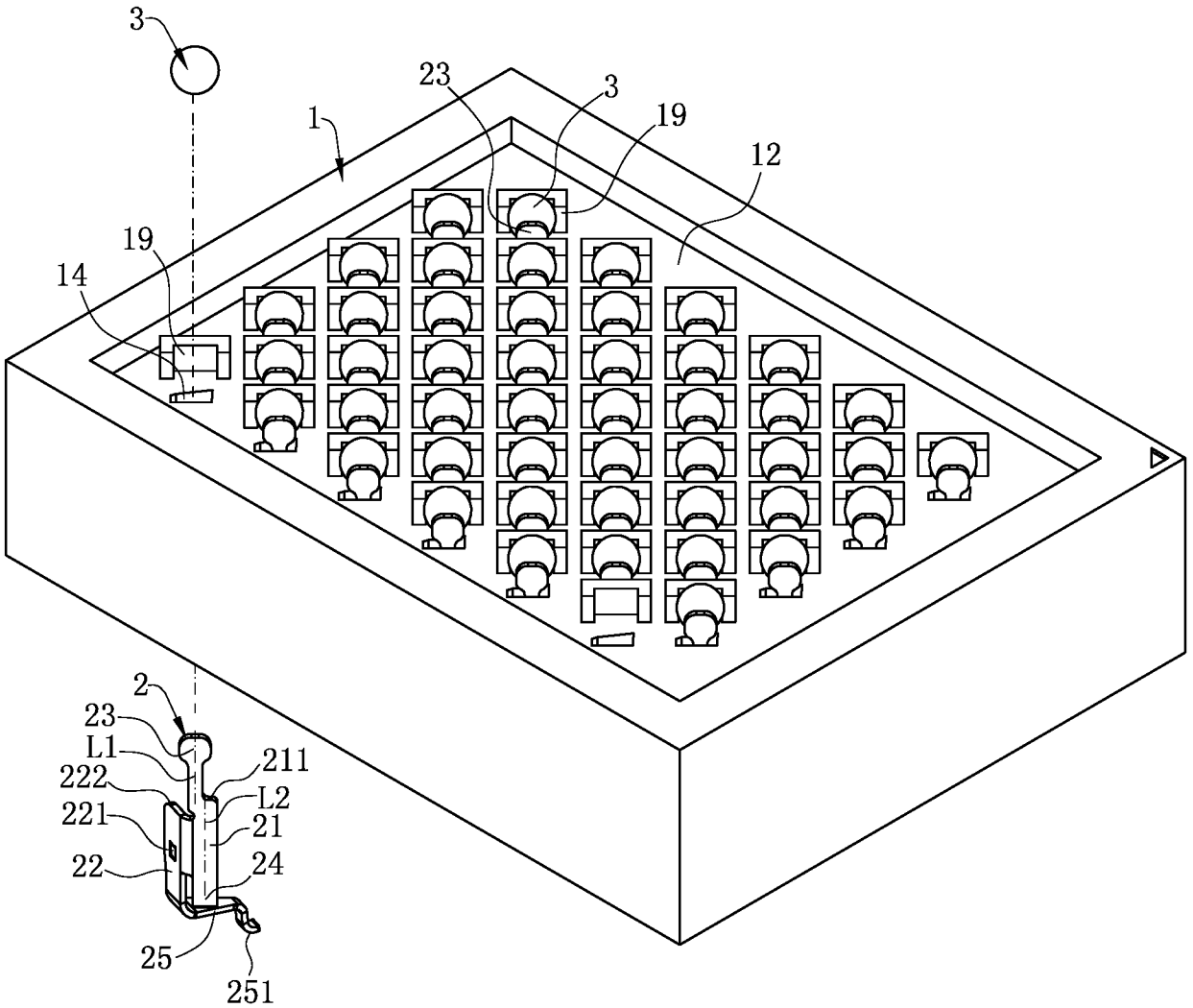
FIG. 2 is a perspective view of the electrical connector in FIG. 1 being inverted by 180°.

As shown in FIG. 1 and FIG. 2, the body 1 is provided with a retaining block 19 protruding downward on one side of each accommodating hole 13.

As shown in FIG. 1, the terminals 2 are made of a metal sheet. The terminals 2 are correspondingly accommodated in the accommodating holes 13. Each terminal 2 includes a base 21, an extending portion 22, a conducting portion 23, a strip connecting portion 24, and an elastic portion 25.

Figure 6:
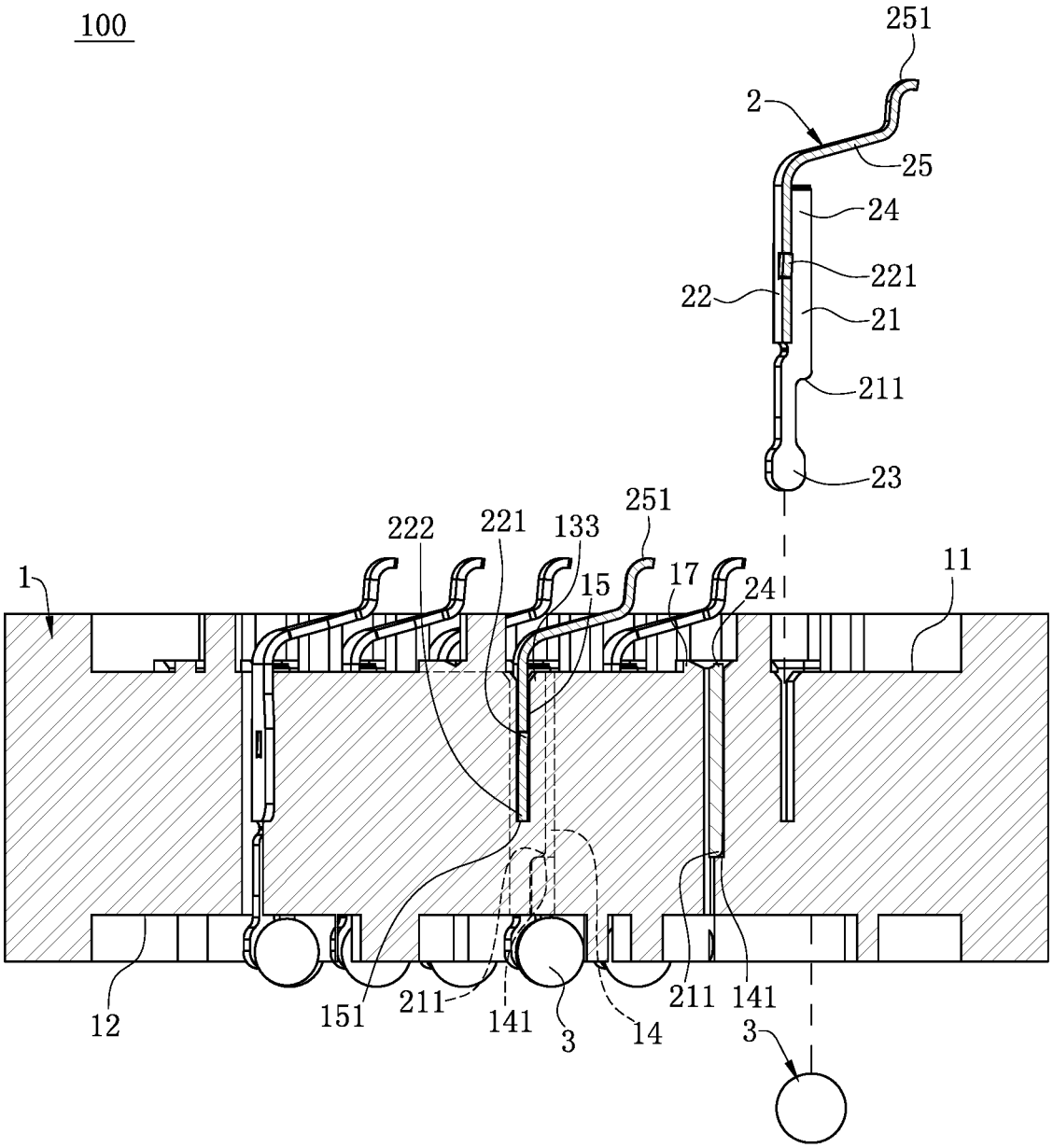
FIG. 6 is a sectional view of the electrical connector in FIG. 3 along a B-B direction.

As shown in FIG. 1, FIG. 4 and FIG. 6, the base 21 is flat plate shaped. The base 21 is accommodated in the first groove 14. The bottom end of the base 21 has a position limiting portion 211. The position limiting surface 141 is located below the position limiting portion 211 to limit the terminal 2 from moving downward.

The extending portion 22 bends and extends from one side of the base 21. The extending portion 22 is accommodated in the second groove 15 through the guide of the guide surface 1331. The extending portion 22 is partially accommodated in the recess groove 16. The extending portion 22 is pierced and broken to form a protruding thorn 221. The protruding thorn 221 is in interference fit with one of the protruding blocks 133 in the corresponding accommodating hole 13 to fix the terminal 2 in the corresponding accommodating hole 13. The bottom end of the extending portion 22 has a stopping portion 222. The stopping portion 222 is located above the position limiting portion 211. The stopping surface 151 is located below the stopping portion 222 to limit the terminal 2 from moving downward.

As shown in FIG. 1 and FIG. 2, the conducting portion 23 is formed by vertically downwardly bending from the bottom end of the base 21. The conducting portion 23 is soldered to the circuit board 5 through a solder 3. In other embodiments, the conducting portion 23 may also elastically abut the circuit board 5. The conducting portion 23 downwardly extends out of the first groove 14. The conducting portion 23 and the retaining block 19 clamp two opposite sides of the solder 3. A vertical central line L1 of the conducting portion 23 deviates from a vertical central line L2 of the base 21 in the horizontal direction. The vertical central line L1 of the conducting portion 23 deviates the vertical central line L2 of the base 21 toward the connecting location between the base 21 and the extending portion 22.

As shown in FIG. 1 and FIG. 5, the strip connecting portion 24 is formed by vertically upwardly extending from the top end of the base 21. The strip connecting portion 24 is configured to be connected with a strip 6. The strip connecting portion 24 upwardly extends out of the first groove 14. The top end of the strip connecting portion 24 is higher than the lower end of the oblique surface 171 and lower than the upper end of the oblique surface 171, such that the strip 6 can be conveniently broken off.

The elastic portion 25 is formed by upwardly bending and extending from the top end of the extending portion 22. The elastic portion 25 upwardly extends out of the second groove 15 (see FIG. 6). The tail end of the elastic portion 25 is provided with a contact portion 251. The contact portion 251 is curved shaped, and is configured to abut the chip module 4 (see FIG. 7).

As shown in FIG. 1, FIG. 5 and FIG. 6, during assembly, each terminal 2 is installed into the corresponding accommodating hole 13 from top to bottom, such that the base 21 is accommodated in the first groove 14 and the extending portion 22 is accommodated in the second groove 15 until the position limiting portion 211 abuts the position limiting surface 141, and the stopping portion 222 abuts the stopping surface 151. The protruding thorn 221 is in interference fit with the protruding block 133. The conducting portion 23 downwardly extends out of the first groove 14. The conducting portion 23 and the retaining block 19 clamp the two opposite sides of the solder 3.

Figure 7:
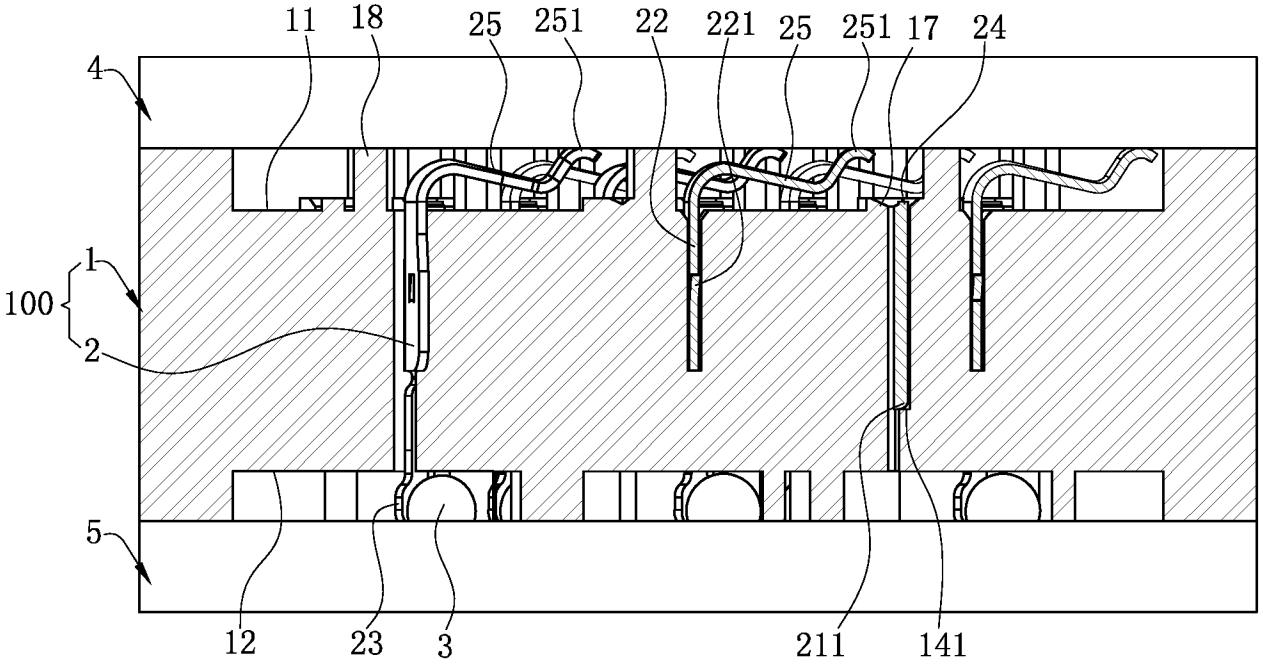
FIG. 7 is a plain view of the electrical connector in FIG. 6 after a chip module is pressed downward.

As shown in FIG. 6 and FIG. 7, when in use, the electrical connector 100 is first placed on the circuit board 5, and the solders 3 are utilized to fixedly solder the electrical connector 100 onto the circuit board 5. The chip module 4 is then mounted onto the electrical connector 100. Then a downward acting force is applied to the chip module 4, such that the chip module 4 downwardly abuts the terminals 2. The extending portion 22 of each terminal 2 is retained in the corresponding second groove 15 to serve as a pivot for the deformation of the elastic portions 25 until the supporting blocks 18 upwardly supports the chip module 4.

Figure 8:
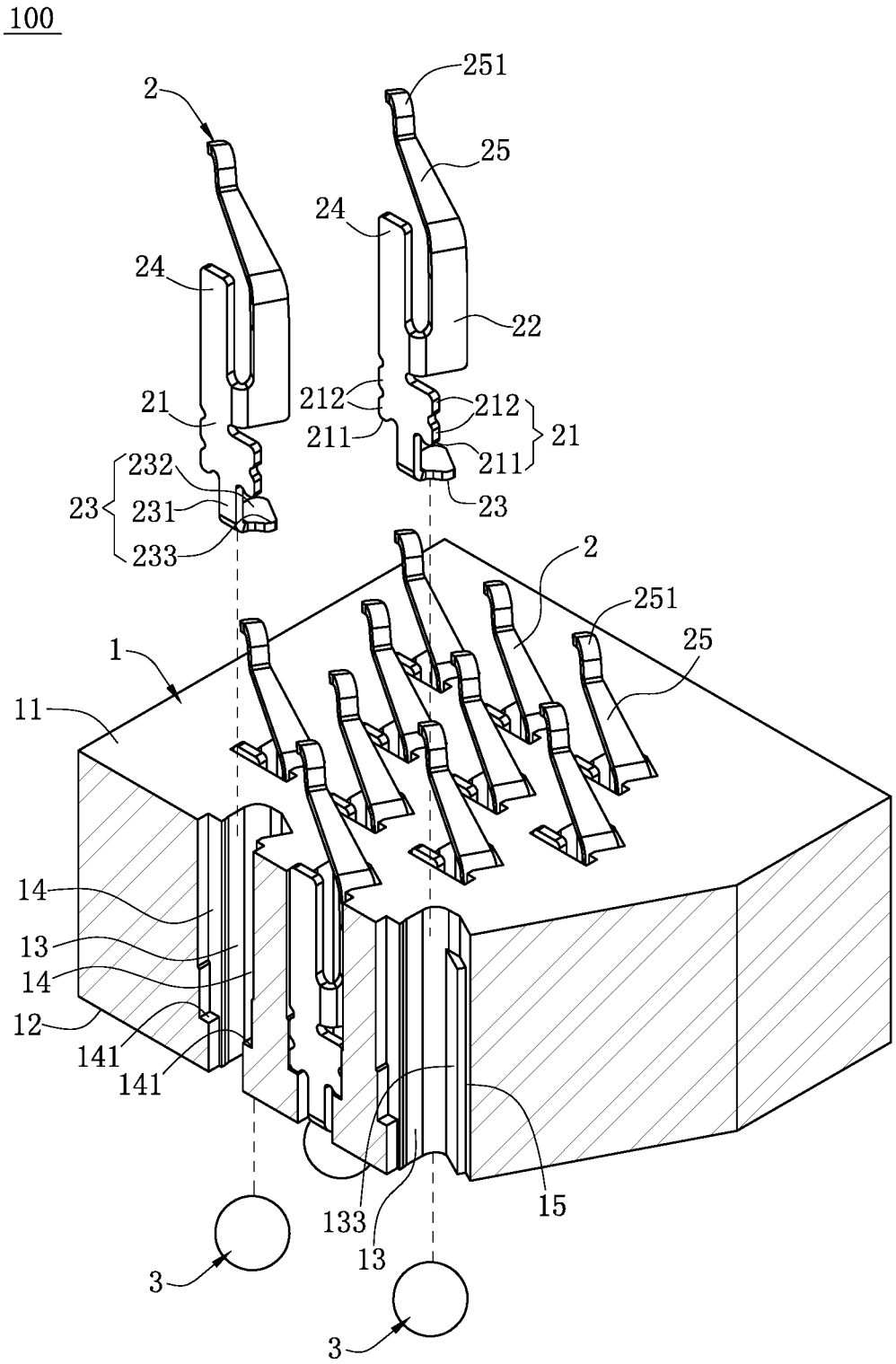
FIG. 8 is a perspective view of the electrical connector according to a second embodiment of the present invention.
Figure 11:
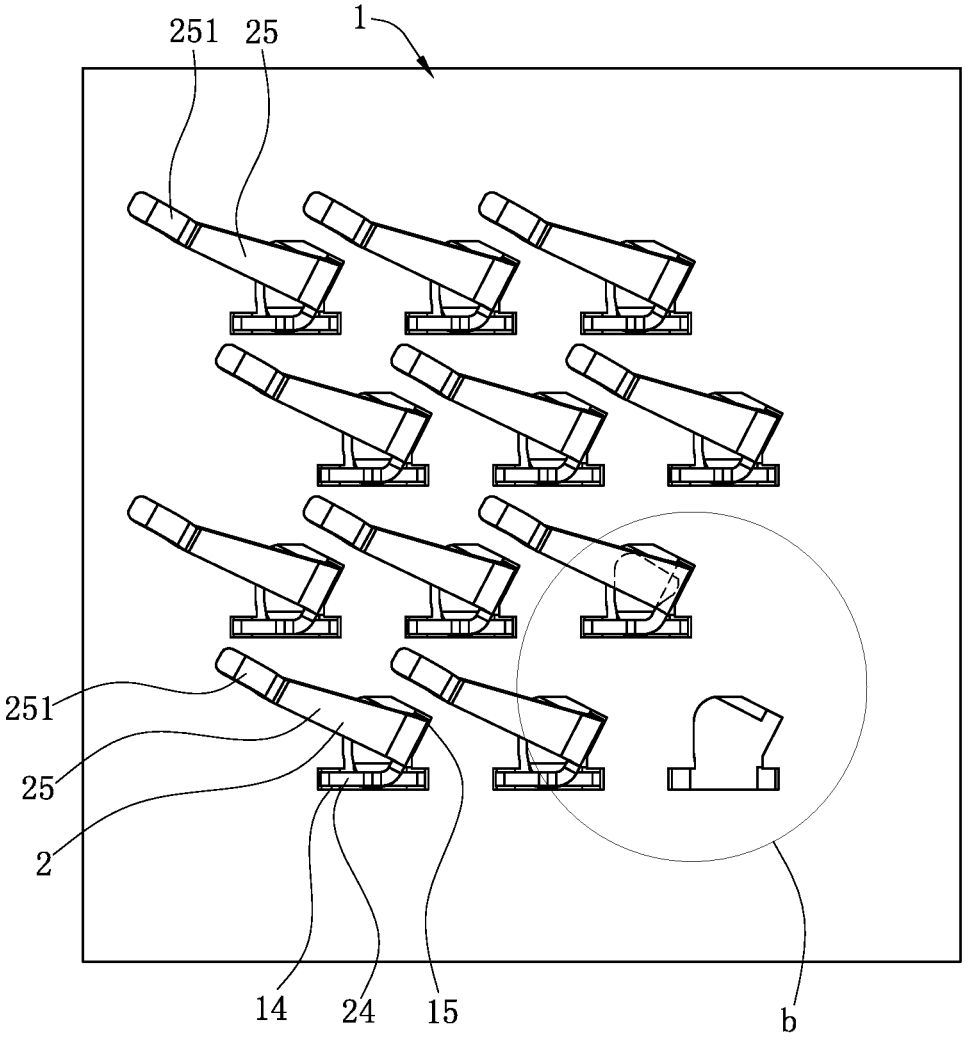
FIG. 11 is a top view of the electrical connector in FIG. 9.
Figure 12:
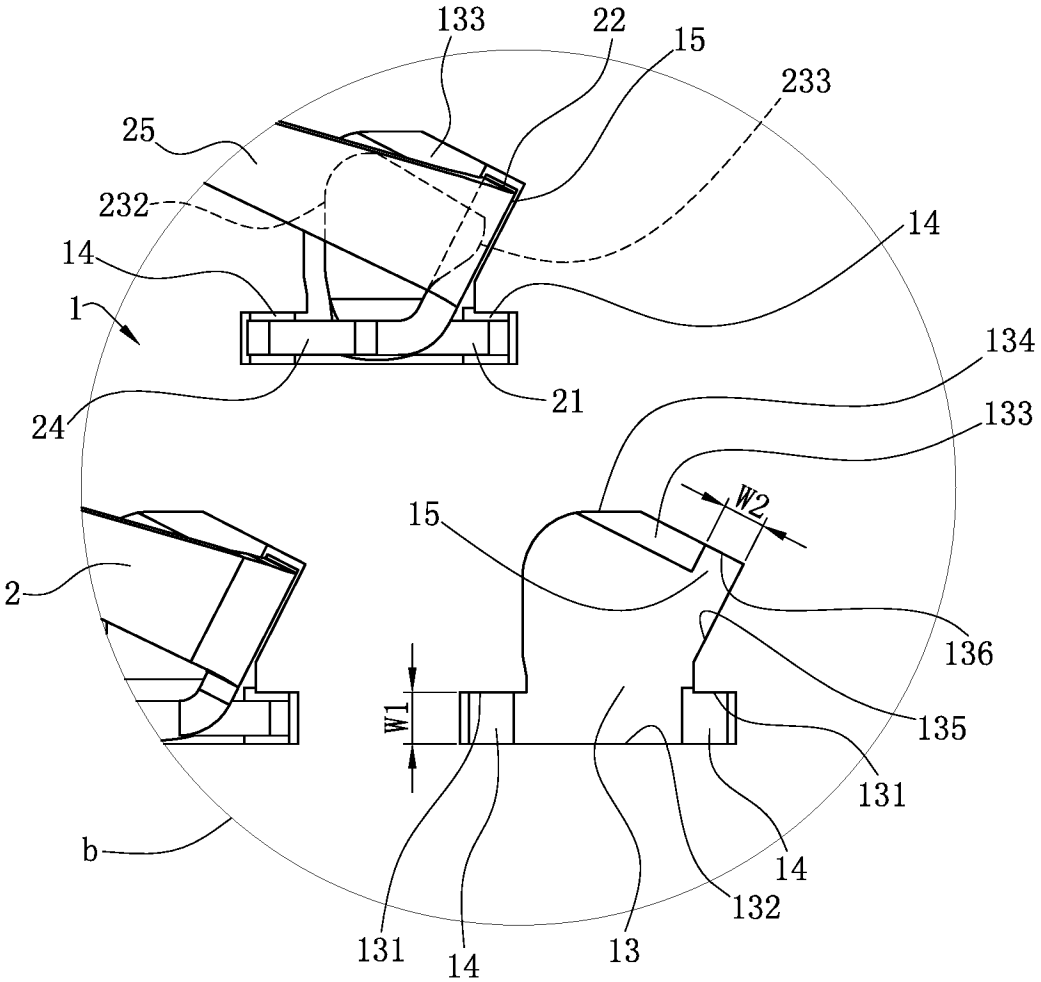
FIG. 12 is an enlarged view of portion b in FIG. 11.

FIG. 8 to FIG. 12 show an electrical connector 100 according to the second embodiment of the present invention. In this embodiment, the structures having the same numbers in the drawings as those in the first embodiment are not elaborated herein. Specifically, the main differences of the electrical connector 100 of the present embodiment from that of the first embodiment exist in that:

As shown in FIG. 8, FIG. 11 and FIG. 12, the first wall surface 131 and the second wall surface 132 are provided oppositely in parallel and jointly define the first groove 14. The distance between the first wall surface 131 and the second wall surface 132 is defined as the width W1 of the first groove 14.

Each accommodating hole 13 has a third wall surface 134 and a fourth wall surface 135 provided opposite to each other, and a fifth wall surface 136 connected with the third wall surface 134 and the fourth wall surface 135. The protruding block 133 is formed by extending toward the accommodating hole 13 from the third wall surface 134. The protruding block 133 is connected with the fifth wall surface 136. The protruding block 133 and the fourth wall surface 135 jointly define the second groove 15. The second groove 15 runs through the lower surface 12. The distance between the protruding block 133 and the fourth wall surface 135 is defined as the width W2 of the second groove 15.

Figure 9:
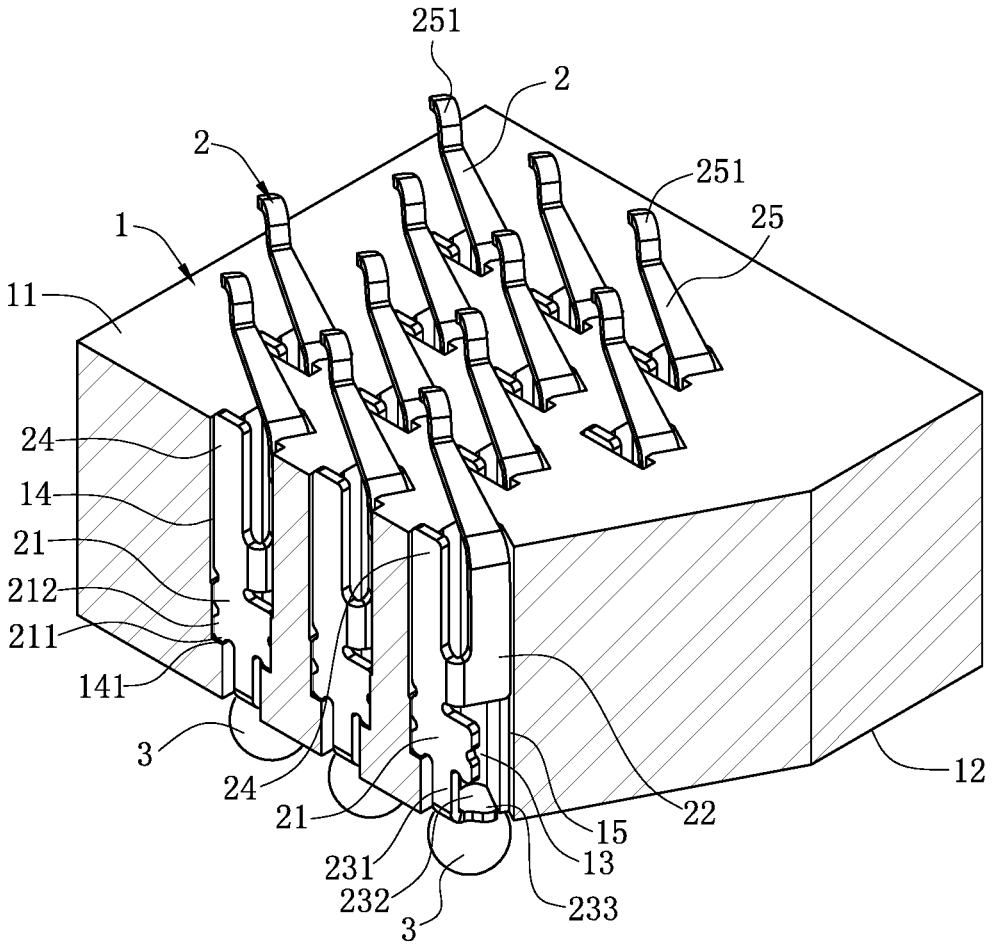
FIG. 9 is a perspective view of the electrical connector in FIG. 8 after the terminals are assembled to a body.
Figure 10:
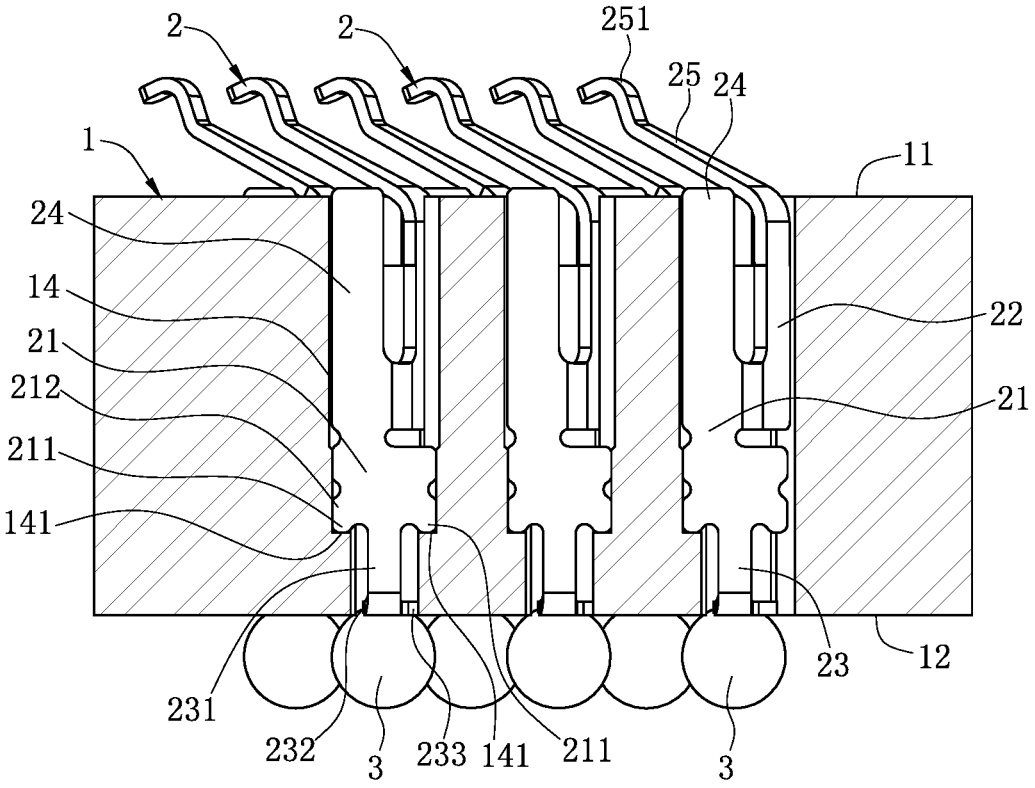
FIG. 10 is a front view of the electrical connector in FIG. 9.

As shown in FIG. 8, FIG. 9 and FIG. 10, the two opposite sides of the base 21 are provided with a plurality of fastening portions 212. The fastening portions 212 are located below the extending portion 22. The fastening portions 212 are in interference fit with the first groove 14 to fix the terminal 2 in the accommodating hole 13. The bottom end of at least one fastening portion 212 has a position limiting portion 211 configured to limit the terminal 2 from moving downward.

In the present embodiment, the two opposite sides of the base 21 are provided with two fastening portions 212. The position limiting portions 211 are provided at the bottom ends of the fastening portions 212 at the lower side. In other embodiments, the position limiting portions 211 may also be provided on the bottom ends of the fastening portions 212 at the upper side. Alternatively, the position limiting portions 211 may be provided on the bottom ends of all of the fastening portions 212.

The conducting portion 23 includes a first portion 231 formed by downwardly vertically extending from the bottom end of the base 21, a second portion 232 formed by horizontally extending from the first portion 231, and a protruding portion 233 horizontally extending from the second portion 232. The protruding portion 233 extends to be located right below the extending portion 22. Both the bottom surface of the second portion 232 and the bottom surface of the protruding portion 233 are soldered with the solder 3, thus enlarging the soldering area between the conducting portion 23 and the solder 3, and ensuring the stable conduction between the electrical connector 100 and the circuit board 5.

To sum up, the electrical connector 100 according to certain embodiments of the present invention has the following beneficial effects:

(1) The base 21 is accommodated in the first groove 14, and the extending portion 22 is accommodated in the second groove 15. Further, the width W2 of the second groove 15 is less than the width W1 of the first groove 14, thus ensuring the position limiting effect of the second groove 15 to the extending portion 22, and further reducing the distance between the position where the terminal 2 abuts the chip module 4 and the position where the terminal 2 is limited in the accommodating hole 13. When the chip module 4 presses downward on the elastic portion 25, the shake of the extending portions 22 in the second grooves 15 can be effectively reduced, thus ensuring the stable conduction between the terminals 2 and the chip module 4.

(2) The fastening portions 212 are in interference fit with the first groove 14, and the position limiting surface 141 are located below the position limiting portion 211, so as to fix the base 21 in the first groove 14, thus effectively preventing the base 21 from shaking in the first groove 14, and further ensuring the stable conduction between the terminals 2 and the chip module 4.

(3) The vertical central line L1 of the conducting portion 23 deviates relative to the vertical central line L2 of the base 21 toward the connecting location between the base 21 and the extending portion 22, such that the conducting portion 23 is close to the center of the first groove 14, thus preventing the conducting portion 23 from interfering with the first groove 14 to cause the terminal 2 not to be correctly installed into the accommodating hole 13.

(4) The extending portion 22 is pierced and broken to form a protruding thorn 221, and the protruding thorn 221 is in interference fit with the second groove 15 to fix the extending portion 22 in the second groove 15, thus effectively preventing the extending portion 22 from shaking in the second groove 15, and further ensuring the stable conduction between the terminals 2 and the chip module 4.

(5) The protruding block 133 is formed by extending toward the accommodating hole 13 from the third wall surface 134 and is connected with the fifth wall surface 136, thus enhancing the strength of the protruding block 133, and further ensuring the position limiting effect of the second groove 15 to the extending portion 22.

(6) The second groove 15 is provided with the stopping surface 151 located below the stopping portion 222, and the first groove 14 is provided with the position limiting surface 141 located below the position limiting portion 211, thus ensuring that the terminals 2 are more balanced in the accommodating holes 13, and further preventing the terminals 2 from shaking in the accommodating holes 13.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector configured to electrically connect a chip module to a circuit board, comprising:

a body configured to upwardly bear the chip module, wherein the body is provided with a plurality of accommodating holes, each of the accommodating holes has a first groove and a second groove, and a width of the second groove is less than a width of the first groove; and a plurality of terminals, correspondingly accommodated in the accommodating holes, wherein each of the terminals comprises:

a base, accommodated in the first groove;

an extending portion, bending and extending from one side of the base and accommodated in the second groove;

a conducting portion, provided on a bottom portion of the terminal and configured to be electrically connected with the circuit board; and an elastic portion, formed by upwardly bending and extending from the extending portion and configured to abut the chip module, wherein each of the accommodating holes comprises a first wall surface and a second wall surface provided opposite to each other, the first wall surface and the second wall surface jointly define the first groove, and the second groove runs through the first wall surface and communicates with the first groove.

2. The electrical connector according to claim 1, wherein the first wall surface and the second wall surface are provided obliquely relative to each other.

3. An electrical connector configured to electrically connect a chip module to a circuit board, comprising:

a body configured to upwardly bear the chip module, wherein the body is provided with a plurality of accommodating holes, each of the accommodating holes has a first groove and a second groove, and a width of the second groove is less than a width of the first groove; and a plurality of terminals, correspondingly accommodated in the accommodating holes, wherein each of the terminals comprises:

a base, accommodated in the first groove;

an extending portion, bending and extending from one side of the base and accommodated in the second groove;

a conducting portion, provided on a bottom portion of the terminal and configured to be electrically connected with the circuit board; and an elastic portion, formed by upwardly bending and extending from the extending portion and configured to abut the chip module, wherein an inner wall of each of the accommodating holes is provided with two protruding blocks opposite to each other, and the two protruding blocks jointly define the second groove.

4. The electrical connector according to claim 3, wherein a top portion of each of the protruding blocks is obliquely provided with a guide surface.

5. An electrical connector configured to electrically connect a chip module to a circuit board, comprising:

a body configured to upwardly bear the chip module, wherein the body is provided with a plurality of accommodating holes, each of the accommodating holes has a first groove and a second groove, and a width of the second groove is less than a width of the first groove; and a plurality of terminals, correspondingly accommodated in the accommodating holes, wherein each of the terminals comprises:

a base, accommodated in the first groove;

an extending portion, bending and extending from one side of the base and accommodated in the second groove;

a conducting portion, provided on a bottom portion of the terminal and configured to be electrically connected with the circuit board; and an elastic portion, formed by upwardly bending and extending from the extending portion and configured to abut the chip module, wherein each of the accommodating holes is provided with two wall surfaces, a protruding block is formed by extending from one of the two wall surfaces toward the accommodating hole, and the protruding block and the other of the two wall surfaces jointly define the second groove.

6. The electrical connector according to claim 3, wherein the body is concavely provided with a plurality of recess grooves corresponding to the accommodating holes, wherein each of the recess grooves is downward concavely provided from one side of the second groove of a corresponding accommodating hole of the accommodating holes, each of the recess grooves communicates with the second groove of the corresponding accommodating hole, a width of each of the recess grooves is greater than the width of the second groove of the corresponding accommodating hole, and each of the recess grooves and the first groove of the corresponding accommodating hole are located on two opposite sides of the second groove of the corresponding accommodating hole.

7. The electrical connector according to claim 6, wherein the extending portion of each of the terminals is partially accommodated in a corresponding one of the recess grooves.

8. The electrical connector according to claim 1, wherein two opposite sides of the base are provided with a plurality of fastening portions, the fastening portions are configured to be in interference fit with the first groove, a bottom end of at least one of the fastening portions has a position limiting portion, and the first groove has a position limiting surface located below the position limiting portion and configured to limit each of the terminals from moving downward.

9. The electrical connector according to claim 1, wherein the extending portion has a stopping portion, and the second groove has a stopping surface located below the stopping portion and configured to limit each of the terminals from moving downward.

10. The electrical connector according to claim 9, wherein the base has a position limiting portion located below the stopping portion, and the first groove has a position limiting surface located below the position limiting portion and configured to limit each of the terminals from moving downward.

11. The electrical connector according to claim 1, wherein the extending portion is pierced and broken to form a protruding thorn, and the protruding thorn is in interference fit with the second groove.

12. The electrical connector according to claim 1, wherein a top end of the base extends upward to form a strip connecting portion configured to be connected with a strip, the body is provided with a plurality of protruding bars corresponding to the accommodating holes, each of the protruding bars protrudes upwardly from one side of the first groove of a corresponding accommodating hole of the accommodating holes, one side of each of the protruding bars located close to the strip connecting portion has an oblique surface, and a top end of the strip connecting portion is higher than a lower end of the oblique surface and lower than an upper end of the oblique surface.

13. The electrical connector according to claim 12, wherein the body is provided with a plurality of supporting blocks corresponding to the accommodating holes, each of the supporting blocks protrudes upwardly from the other side of the first groove of a corresponding accommodating hole of the accommodating holes, a top surface of each of the supporting blocks is higher than a top surface of each of the protruding bars, and the supporting blocks are configured to upwardly bear the chip module.

14. The electrical connector according to claim 1, wherein the body is concavely provided with a plurality of recess grooves corresponding to the accommodating holes, wherein each of the recess grooves is downward concavely provided from one side of the second groove of a corresponding accommodating hole of the accommodating holes, each of the recess grooves communicates with the second groove of the corresponding accommodating hole, a width of each of the recess grooves is greater than the width of the second groove of the corresponding accommodating hole, each of the recess grooves and the first groove of the corresponding accommodating hole are located on two opposite sides of the second groove of the corresponding accommodating hole, and the extending portion of each of the terminals is partially accommodated in a corresponding one of the recess grooves.

15. The electrical connector according to claim 3, wherein the extending portion has a stopping portion, and the second groove has a stopping surface located below the stopping portion and configured to limit each of the terminals from moving downward.

16. The electrical connector according to claim 15, wherein the base has a position limiting portion located below the stopping portion, and the first groove has a position limiting surface located below the position limiting portion and configured to limit each of the terminals from moving downward.

17. The electrical connector according to claim 3, wherein the extending portion is pierced and broken to form a protruding thorn, and the protruding thorn is in interference fit with the second groove.

18. The electrical connector according to claim 3, wherein a top end of the base extends upward to form a strip connecting portion configured to be connected with a strip, the body is provided with a plurality of protruding bars corresponding to the accommodating holes, each of the protruding bars protrudes upwardly from one side of the first groove of a corresponding accommodating hole of the accommodating holes, one side of each of the protruding bars located close to the strip connecting portion has an oblique surface, and a top end of the strip connecting portion is higher than a lower end of the oblique surface and lower than an upper end of the oblique surface.

19. The electrical connector according to claim 18, wherein the body is provided with a plurality of supporting blocks corresponding to the accommodating holes, each of the supporting blocks protrudes upwardly from the other side of the first groove of a corresponding accommodating hole of the accommodating holes, a top surface of each of the supporting blocks is higher than a top surface of each of the protruding bars, and the supporting blocks are configured to upwardly bear the chip module.

20. The electrical connector according to claim 5, wherein two opposite sides of the base are provided with a plurality of fastening portions, the fastening portions are configured to be in interference fit with the first groove, a bottom end of at least one of the fastening portions has a position limiting portion, and the first groove has a position limiting surface located below the position limiting portion and configured to limit each of the terminals from moving downward.

* * * * *